US005680952A

United States Patent [19]

Chasteen

[11] Patent Number: 5,680,952

[45] Date of Patent: Oct. 28, 1997

[54] END CONSTRUCTIONS FOR CONTAINERS

[75] Inventor: Howard Curtis Chasteen, Golden, Colo.

[73] Assignee: Ball Corporation, Muncie, Ind.

[21] Appl. No.: 515,081

[22] Filed: Sep. 1, 1995

Related U.S. Application Data

[63] Continuation-in-part of Ser. No. 304,676, Sep. 12, 1994.

[51] Int. Cl.[6] ..... B65D 17/32; B65D 41/32

[52] U.S. Cl. ..... 220/268; 220/266; 220/281; 220/906

[58] Field of Search ..... 220/617, 703, 220/712, 715, 906, 263, 266, 268, 277, 281; 222/265, 266

[56] References Cited

U.S. PATENT DOCUMENTS

| | | | |
|---|---|---|---|
| 163,747 | 5/1875 | Cummings . | |
| 266,906 | 10/1882 | Sherwood . | |
| 1,672,839 | 6/1928 | Ruttan et at. . | |
| 2,077,027 | 4/1937 | Torras . | |
| 2,120,186 | 6/1938 | Punte . | |
| 2,339,763 | 1/1944 | Calleson et al. . | |
| 2,367,300 | 1/1945 | McManus et al. . | |
| 2,379,680 | 7/1945 | Burdick . | |
| 2,426,550 | 8/1947 | Coyle . | |
| 3,272,671 | 9/1966 | Gaylord et al. . | |
| 3,334,775 | 8/1967 | Klein et al. . | |
| 3,485,355 | 12/1969 | Stewart . | |
| 3,642,169 | 2/1972 | Webster et al. . | |
| 3,794,206 | 2/1974 | De Line et al. . | |
| 3,887,105 | 6/1975 | Chiappe . | |
| 3,905,507 | 9/1975 | Lyu . | |
| 3,929,251 | 12/1975 | Urmston . | |
| 3,931,890 | 1/1976 | Davis . | |
| 3,979,009 | 9/1976 | Walker . | |
| 4,120,419 | 10/1978 | Saunders . | |
| 4,147,271 | 4/1979 | Yamaguchi . | |
| 4,244,489 | 1/1981 | Klein . | |
| 4,244,490 | 1/1981 | Kein . | |
| 4,341,321 | 7/1982 | Gombas . | |
| 4,363,404 | 12/1982 | Westphal . | |
| 4,412,627 | 11/1983 | Houghton et al. . | |
| 4,489,848 | 12/1984 | Braude | 200/712 |
| 4,515,284 | 5/1985 | Lee, Jr. et al. . | |
| 4,518,096 | 5/1985 | Winstead | 220/712 X |
| 4,615,459 | 10/1986 | Clements | 220/712 X |
| 4,784,283 | 11/1988 | Cantu | 220/712 X |
| 4,919,294 | 4/1990 | Kawamoto et al. . | |

FOREIGN PATENT DOCUMENTS

| | | |
|---|---|---|
| 2398669 | 3/1979 | France . |

*Primary Examiner*—Allan N. Shoap
*Assistant Examiner*—Niki M. Kopsidas
*Attorney, Agent, or Firm*—Sheridan Ross, P.C.

[57] ABSTRACT

A container (e.g., drawn and ironed) with modified end constructions is disclosed. In one embodiment, the end piece which is seamed onto the sidewall of the container body includes a push-down tab for opening the container. This tab includes at least one engagement section which is offset in relation to the center of the push-down tab and which is for interfacing with the consumer's finger (e.g., thumb) in a manner which facilitates a more effective opening of the push-down tab. The engagement section curves upwardly progressing toward the perimeter of the tab and therefore may be characterized as a generally ramped surface. In one embodiment, two such engagement sections are utilized and ramp upwardly in generally opposite directions. The integral end of the container body also includes a multi-stage center panel or dome for allowing stacking of filled containers.

10 Claims, 18 Drawing Sheets

END CONSTRUCTIONS FOR CONTAINERS

RELATED APPLICATIONS

This application is a continuation-in-part of U.S. patent application Ser. No. 08/304,676, filed Sep. 12, 1994, the entire disclosure of which is incorporated by reference herein.

FIELD OF THE INVENTION

The present invention generally relates to the field of containers (e.g., drawn and ironed) and, more particularly, to structures utilized for the ends of containers.

BACKGROUND OF THE INVENTION

Significant efforts have been expended by drawn and ironed beverage container producers to gain a competitive advantage within the industry. For instance, efforts have been and continue to be directed to designing containers formed from thinner sheet metal stock to reduce material and thus overall production costs. Relatedly, efforts have concentrated on improving the performance of the container, such as maintaining sufficient strength characteristics which are often imposed by the beverage fillers when using the noted thinner sheet metal stocks (e.g., end piece buckle strength, static dome reversal strength, drop resistance of the dome). Additional design efforts have been driven by the beverage consumer, such as by addressing the manner in which the containers are opened.

Although purchasers of beverage container bodies and the associated container end pieces (e.g., beverage producers and including their beverage fillers and distributors) will likely continue to be influenced by the cost and performance of the container, beverage producers always welcome increased sales. Increases in sales of course can be attributed to a new beverage product. However, modifications of product packaging can also have a profound effect on the sale of the product. In the case of metal drawn and ironed beverage containers, outside of the printing which appears on the sidewall of the container, little has been done in this area.

SUMMARY OF THE INVENTION

One aspect of the present invention is directed to a metal, drawn and ironed container which includes a container body (i.e., a sidewall and an integral bottom and thus of one-piece construction and formable from a single piece of sheet metal) with a separate end piece attached thereto. Generally, the end piece includes a crown or a raised column-like or neck-like structure through which the beverage is dispensed and the bottom of the container body includes a multi-stage center panel or dome, for instance to accommodate stacking of the containers. More specifically, and in fact an aspect in and of itself, the multi-stage center dome is generally concave (e.g., generally upwardly projecting to define an open space or cavity beneath the container), is typically disposed above the container's supporting surface by an inner wall, and includes at least three distinct and separately visually discernible sections. One of these sections is a first stage dome which is annular and inclined relative to the container's central, vertical axis such that its lower end is displaced further from the axis than its upper end. Typically, the first stage dome extends along an arcuate path between its lower and upper ends, and even more typically is a spherical-type radius. A dome transition section is disposed above the first stage dome, is also annular, and extends upwardly from the first stage dome at a generally steeper angle relative to the axis (i.e., its slope is greater than that of at least the upper portion of the first stage dome or is more "vertical"). Finally, a second stage dome is disposed above the dome transition section and may assume a variety of configurations (e.g., substantially spherically-shaped, substantially flat).

The above-described multi-stage dome compliments the configuration of the crowned end piece for stacking and allows the container to maintain sufficient performance characteristics or in fact offer certain performance improvements (e.g., buckle strength, dome reversal pressure, dome drop resistance). For instance, the diameter of the uppermost portion of the crown may be such that it is received within the area defined by the dome transition section and the second stage dome, and may be further selected such that it is snugly received at the interconnection between the dome transition section and the second stage dome and engages part of the multi-stage dome to offer improved stability. Moreover, various dimensions may be selected such that only the crown of one container supports a container stacked thereon and such that the gap between more perimeter portions of these vertically adjacent containers is small. As such, additional points of contact and support are provided to resist tipping of the stacked container beyond a certain orientation and preferably before the upper container is totally displaced from the lower container. Furthermore, in the case where the drawn and ironed container includes a nose or exteriorly convexly-shaped annular support, the diameter of the innermost portion thereof may be selected such that it stacks on the outside of the interconnection or seam between the end piece and sidewall.

Further aspects of the present invention are specifically directed to the configuration of the above-noted end piece and even more particularly to the structure for opening the container. End pieces may be generally characterized as being comprised of a panel, a push-down tab within a portion of the panel, and a flange-like which facilitates the seaming of the end piece onto a container body to seal the same. Typically, an annular groove is also formed in the end piece at the juncture between the flange-like structure and the panel such that the adjacent annular part of the panel is disposed at a "higher" elevation than the base of the annular groove.

In the case of the above-described combination of a crowned end piece and a multi-stage dome for a container, the end piece includes a skirt or apron which is concentrically positioned above a central axis of the end piece and which may be generally frustumly-shaped or the shape of an inverted cone which is truncated. The lower annular part of the skirt or apron may be also configured to allow for a seaming of the end piece onto the sidewall of the container body (e.g., the above-noted flange-like structure). The crown or neck-like/column-like structure extends upwardly from the upper part of the skirt or apron (e.g., having a sidewall which may be cylindrical surface and vertically extending, a diverging surface, or a converging surface) a distance which allows access by a person's mouth when drinking therefrom. In this regard, the crown includes a push-down tab with a specially contoured engagement section for applying an effective force on the push-down tab to open the same, typically with the thumb.

As noted, the aspect directed solely to the end piece is even more specifically directed to the configuration of the push-down tab (e.g., principles described herein relating to the push-down tab may be applicable to other end piece configurations other than the crowned end piece described above). In this regard, one feature which may be used in the above-described combination and potentially with other end piece configurations is for the specially contoured engagement section to be offset relative to the tab's central axis. Another variation which may be used in the above-noted combination and potentially with other end piece configurations is for the specially contoured engagement section to have its perimeter defined by an arcuately extending rib which is oriented to extend generally about the push-down tab's central axis. A further feature which may be used in the above-noted combination and potentially with other end piece configurations is for the specially contoured engagement section to be an upwardly extending or ramped surface which begins in an interior portion of the push-down tab and extends outwardly toward a perimeter of the push-down tab, with the push-down tab further including a substantially planar section. As such, the total projection of the specially contoured engagement section is less than 360° of the push-down tab and thus offers an easy visual indication to a user of where to exert the compressive forces required to open the container.

In each of the above-noted variations of the specially contoured engagement section, further features may be utilized. For instance, the engagement section may be a substantially concave arcuate surface. This arcuate surface may approximate the contour of a human finger (e.g., the thumb) to enhance comfort when opening, may include a part which is recessed relative to remaining portions of the push-down tab such that the engagement surface initially actually dips down to a degree and then up, and may extend upwardly progressing from its starting point toward its perimeter. Furthermore and in the case of a crowned end piece, the crown may further include an annular border and a generally circular recess such that the push-down tab is positioned below the recess and has a greater diameter than the sidewall defining the recess (i.e., if the push-down tab becomes dislodged, the potential for being dispensed from the container is significantly reduced).

In still a further aspect relating to a push-down tab, in one embodiment the push-down tab includes first and second raised engagement sections. These first and second engagement sections are disposed on the push-down tab such that they are simultaneously engaged by a user to assist the user in opening the container. For instance, the first engagement section may be disposed to supportably engage a forward portion of the user's finger, while the second engagement section may be disposed to supportably engage a more rearward portion of the user's finger. This may be affected by having each of the first and second raised engagement sections be generally ramped surfaces which extend upwardly away from a common point in generally opposite directions (e.g., such that the first and second engagement sections collectively define a generally concave surface, such as a generally V-shaped or U-shaped configuration). In this case, the tip of the user's finger will maintain engagement with the push-down tab, typically the first engagement section, throughout opening of the push-down tab (e.g, the noted configuration has substantially no slap open effect). By positioning the first engagement section closer to the hinge than the second engagement section such that the second engagement section is actually disposed adjacent the score opposite the hinge, the user's finger and/or remaining portions of the user's hand will also provide a shield to any venting of the container when opened.

DETAILED DESCRIPTION

Figure 1:
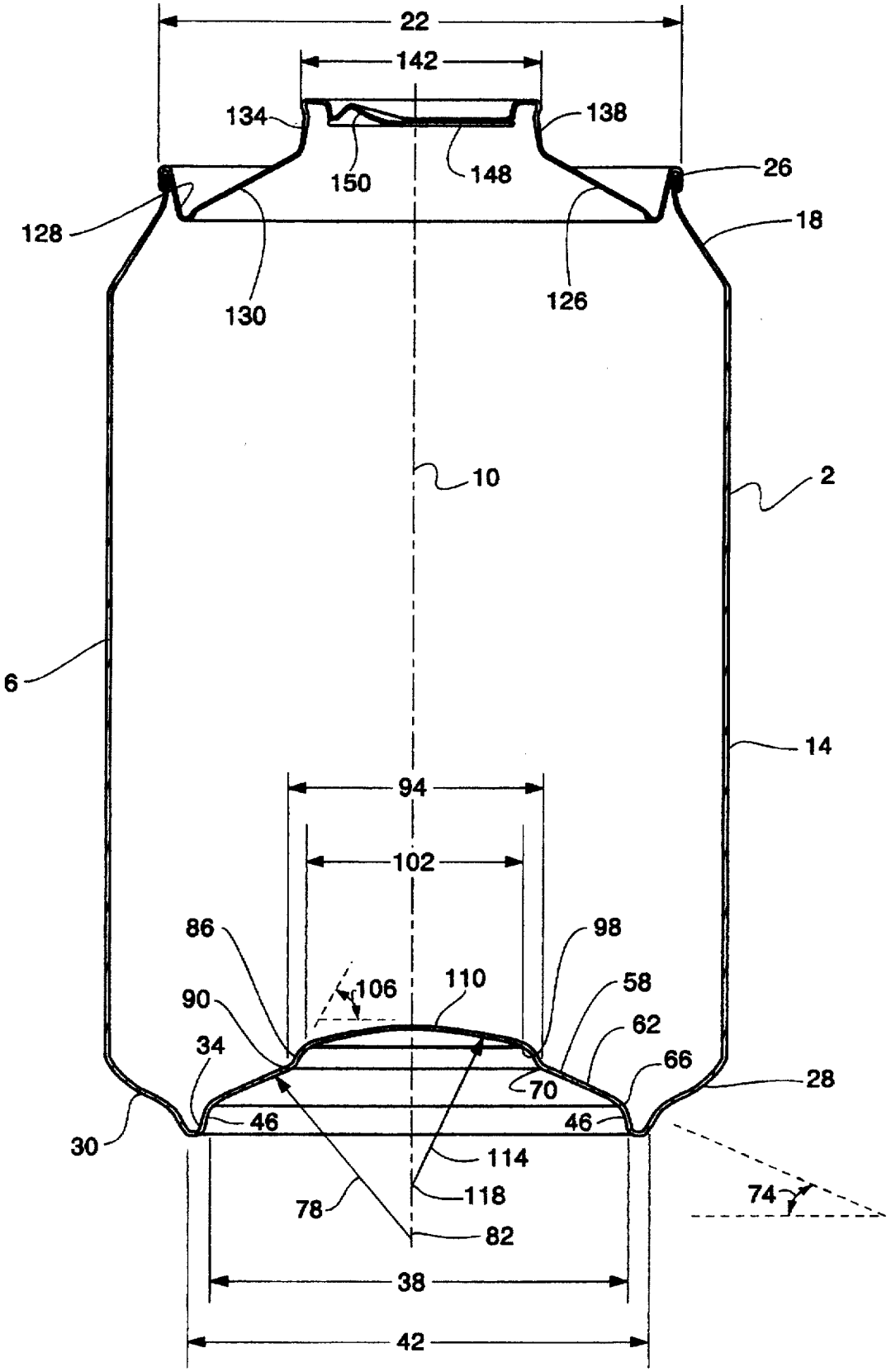
FIG. 1 is a cross-sectional view of a drawn and ironed container.

The present invention will be described with regard to the accompanying drawings which assist in illustrating the various pertinent features thereof. A metal, drawn and ironed container 2 is illustrated in FIG. 1 and generally includes a container body 6 and an end piece 126 which is separately attached thereto. The container body 6 includes a sidewall 14 (e.g., a smooth cylindrical surface, a generally cylindrical surface with ribs or flutes, etc.) which is disposed circumferentially about a central axis 10. A tapered in neck 18 is formed on the upper end of the sidewall 14 to allow, for instance, for the reduction of the diameter of the end piece 126 attached thereto. A bottom 28 is integrally formed with the lower portion of the sidewall 14 (i.e., such that the container body 6 is an integral piece or of one-piece construction) and includes an exteriorly convexly-shaped or nose-shaped annular support 34 having an inner annular support diameter 38 (the diameter of the radially innermost annular part of the annular support 34) and an outer annular support diameter 42 (the diameter of the radially outermost annular part of the annular support 34).

The bottom 28 further includes a transition wall 30 which extends between and interconnects the annular support 34 and the sidewall 14 and which may assume a variety of configurations. Moreover, the bottom 28 includes an inner wall 46 which extends generally linearly at an acute angle relative to a vertical axis parallel with the central axis 10 and which disposes a multi-stage center panel or dome 58 above the annular support 34. Other orientations of the inner wall 46 may be appropriate (e.g., substantially vertical).

Figure 2:
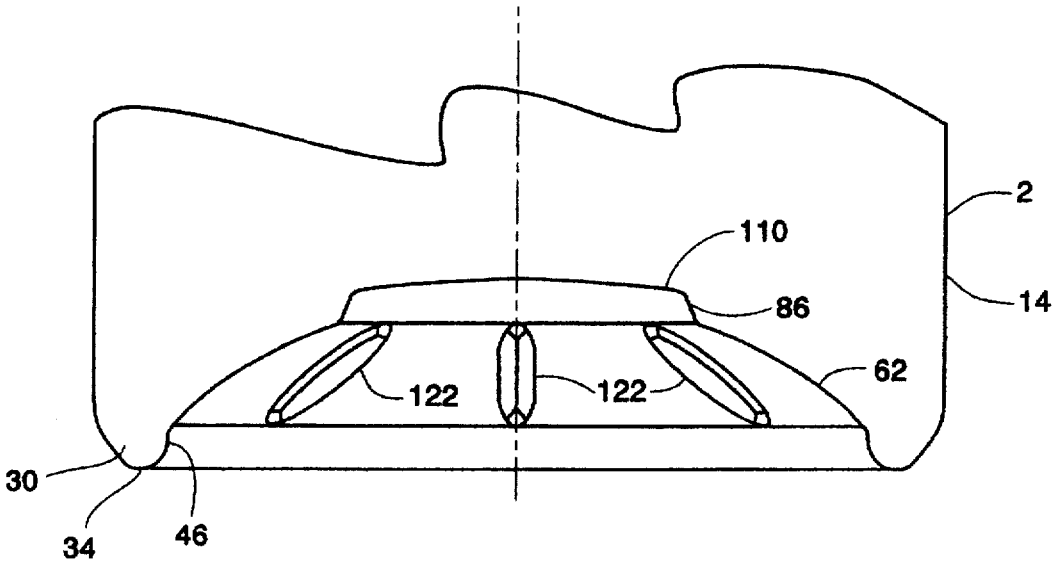
FIG. 2 is a cutaway side view of a multi-stage dome which includes reinforcement beads.
Figure 3:
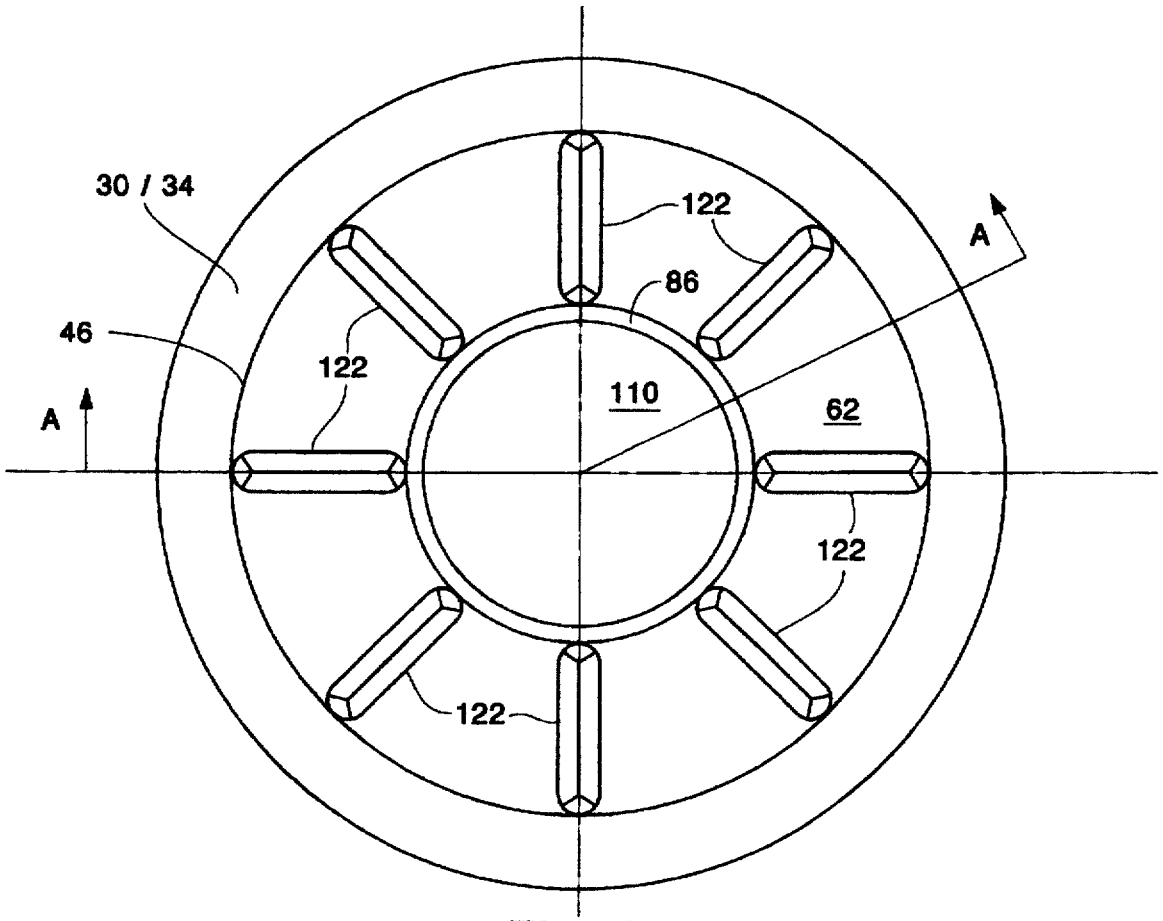
FIG. 3 is a bottom view of the multi-stage dome of FIG. 2.

The multi-stage dome 58, which may be formed by a similarly-shaped domer, includes an annular first stage dome 62 which extends from its lower end 66 to its upper end 70 generally inwardly toward the central axis 10 and generally at a first angle 74 which in the illustrated embodiment is acute. Typically, the first stage dome 62 will be arcuate between its lower end 66 and upper end 70, and will even more typically be defined by a first radius 78 which has a first origin 82 on the central axis 10. The first stage dome 62 may be further characterized as being part of a substantially spherical structure. If desired/required, the first stage dome 62 may include reinforcement beads 122 (e.g., generally concave, generally convex reinforcement structures) as illustrated in FIGS. 2–3.

Referring back to FIG. 1, the multi-stage dome 58 further includes a second stage dome 110 displaced above the first stage dome 62 and which occupies the central portion of the multi-stage dome 58. Although the second stage dome 110 may assume a variety of configurations (e.g., substantially flat), in the illustrated embodiment it is generally spherically shaped and defined by a second radius 114 which has a second origin 118 on the central axis 10. The first radius 78 of the first stage dome 62 and the second radius 114 of the second stage dome 110 may be equal such that the first origin 82 and second origin 118 are offset on the central axis 10 as shown in FIG. 1, or the first origin 82 and second origin 118 may be coincident such that the second radius 114 is greater than the first radius 78 (not shown).

An annular dome transition section 86 provides the offset between the first stage dome 62 and the second stage dome 110 or more specifically displaces the second stage dome 110 above the first stage dome 62 by the "vertical" extent of the section 86. The dome transition section 86 extends from its lower end 90 (which generally coincides with the upper end 70 of the first stage dome 62) to its upper end 98 (which generally coincides with the start of the second stage dome 10) at a transition angle 106 which is greater than the first angle 74, or at least the upper portion of the first stage dome 62 (i.e., the dome transition section 86 is steeper or more vertically oriented than at least the upper portion of the first stage dome 62, and possibly steeper than the entire first stage dome). The transition angle 106 may be acute as illustrated, may be substantially vertical, or may be obtuse, as long as the desired offset between the first stage dome 62 and second stage dome 110 is achieved. However, other considerations such as manufacturability may dictate that the transition angle 106 be vertical or acute. Moreover, with the dome transition section 86 being at a generally acute angle, it can serve as a self-centering feature when stacking containers 2. Although the dome transition section 86 may assume a variety of configurations (e.g., substantially linearly extending between its lower end 90 and its upper end 98), it may also be generally arcuate. Moreover, the annular lower end 90 of the section 86 defines a lower transition diameter 94 and the annular upper end 98 defines an upper transition diameter 102.

Figure 4:
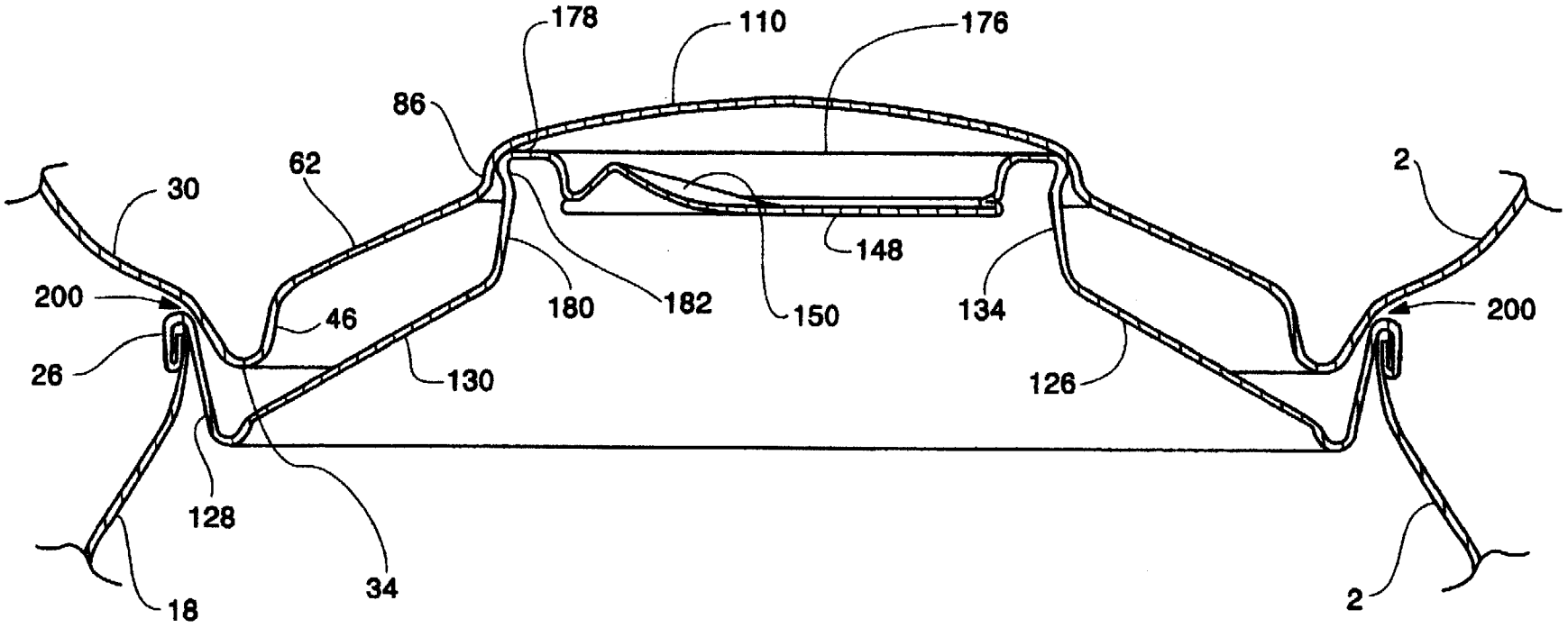
FIG. 4 is a cross-sectional view of adjacent portions of two stacked containers utilizing one type of stacking configuration.

Referring to FIGS. 1 and 4, the end piece 126 is of one-piece construction and is separately attached to the upper part of the neck 18 of the container body 6, such as by seaming. The seaming operation defines an annular standing seam 26 which has a seam diameter 22 (more typically referred to as the neck diameter since it is also effectively the diameter of the neck 18). An annular transition section 128 extends downwardly from the seam 26 toward the central axis 10. A skirt or apron 130 is interconnected with the transition section 128 by an arcuate portion and extends generally upwardly and inwardly toward the central axis 10 (e.g., assuming a generally frustumly-shaped configuration). Both the transition section 128 and skirt 130 are concentrically positioned about the central axis 10 of the container 2.

A column-like or neck-like crown 134 extends upwardly from a plane containing the seam 26 a sufficient distance to allow for effective drinking from the crown 134 upon an opening of the container 2. The crown 134 includes a crown sidewall 138. A first section 180 of the crown sidewall 138 converges toward the central axis 10 (i.e., tapers inwardly), while a second section 182 diverges from the central axis 10 (i.e., tapers outwardly). The crown 134 further includes a top 176 which has an annular, substantially horizontally disposed perimeter section 178 and a recessed tab 148 (i.e., positioned at a lower elevation than the perimeter section 178) which is the openable structure which will be discussed in more detail below. The crown 134 is also centered relative to the central axis 10 and the radially outermost annular portion thereof defines a crown diameter 142.

The multi-stage dome 58 allows for convenient stacking of the containers 2. Generally, the crown 134 is received within the space defined by the dome transition section 86 and the second stage dome 110. Once again, the dome transition section 86 may provide a centering feature for effective stacking. Moreover, the various dimensions may also be selected to vary the degree/type of support/interlock achieved when stacking. For instance, referring to FIG. 4 the annular support 34 of the upper container 2 is positioned radially interiorly of the seam 26 of the lower container 2. Moreover, the crown diameter 142 is generally equal to the upper transition diameter 102 such that the crown 134 is snugly received within and contacts generally the arcuate interconnection between the dome transition section 86 and the second stage dome 110 (e.g., a desired interlocking relationship is established when stacking). Moreover, various dimensions are selected such that the crown 134 is actually the only contact between the adjacent containers 2. That is, there is a gap 200 between the seam 26 of the lower container 2 and the vertically aligned portion of the upper container 2, namely its transition wall 30. The size of this gap 200 may be selected such that upon a tipping or tilting of the upper container 2, the transition wall 30 of the upper container 2 will contact the seam 26 of the lower container 2 over an arcuate region before the upper container 2 will be totally displaced from the lower container 2, absent of course excessive forces.

Figure 5:
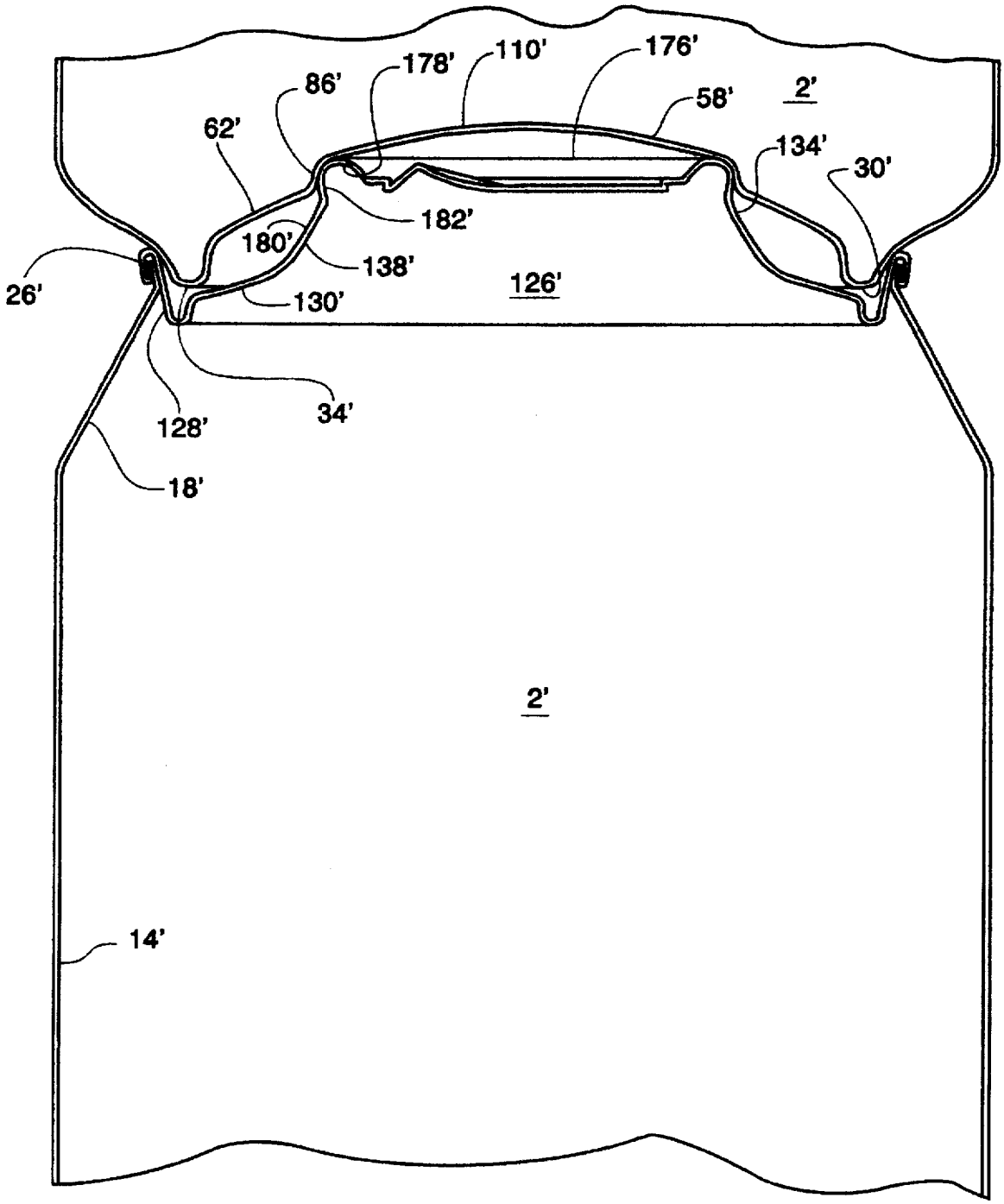
FIG. 5 is a cross-sectional view of adjacent portions of two stacked containers utilizing another type of stacking configuration.

A variation in certain of the dimensions of the containers 2' illustrated in FIG. 5 (which also includes a modified configuration for the crown 134' as discussed below) allows not only for the annular support 34' of the upper container 2' to be displaced inwardly of the seam 26' of the lower container 2', but also for the crown 134' of the lower container 2' to engage the multi-stage dome 58' of the upper container 2' and for the seam 26' of the lower container 2' to engage the transition wall 30' of the upper container 2'. That is, the upper container 2' is annularly supported at two discrete locations in a static position.

The structure of the end piece 126' illustrated in FIG. 5 also differs from the end piece 126 of FIG. 1. Initially, the skirt 130' is disposed at a significantly less angle relative to a horizontal plane than the skirt 130 of FIG. 1, and is of much shorter length. Similarly, the first section 180' of the crown sidewall 138' is disposed at a significantly less angle relative to a horizontal plane than the first section 180 of FIG. 1. Furthermore, the perimeter section 178' of the top 176' of the crown 134' of FIG. 5 is arcuate versus the substantially flat configuration of FIGS. 1 and 4. As such, when stacking the containers 2' the top 176', more specifically its perimeter section 178', may engage a larger area than the configuration illustrated in FIG. 4 since the crown 134' is more arcuate and generally approximates the contour of an upper portion of the dome transition section 86', the outer part of the second stage dome 110', and the interconnection therebetween. Moreover, the top 178' is disposed at a generally divergent-like angle.

Notwithstanding the above-noted differences between the end piece 126 of FIG. 1 and the end piece 126' of FIG. 5, the structure of the push-down tabs 148 and 148' are similar. As will be discussed in more detail below, the structure of the push-down tab 148 (and thus the push-down tab 148') provides desirable advantages in and of itself. The push-down tab 148 (and thus the push-down tab 148') may therefore be utilized with other end piece configurations. For instance, the push-down tab 148 may be utilized with "conventional" end pieces used in soft drink and beer containers (e.g., end pieces which have a substantially planar center panel on which the push-down tab 148 could be positioned, which is surrounded by an annular groove, and which is recessed relative to the upper portion of the seam which interconnects the end piece and the container body).

Figure 6:
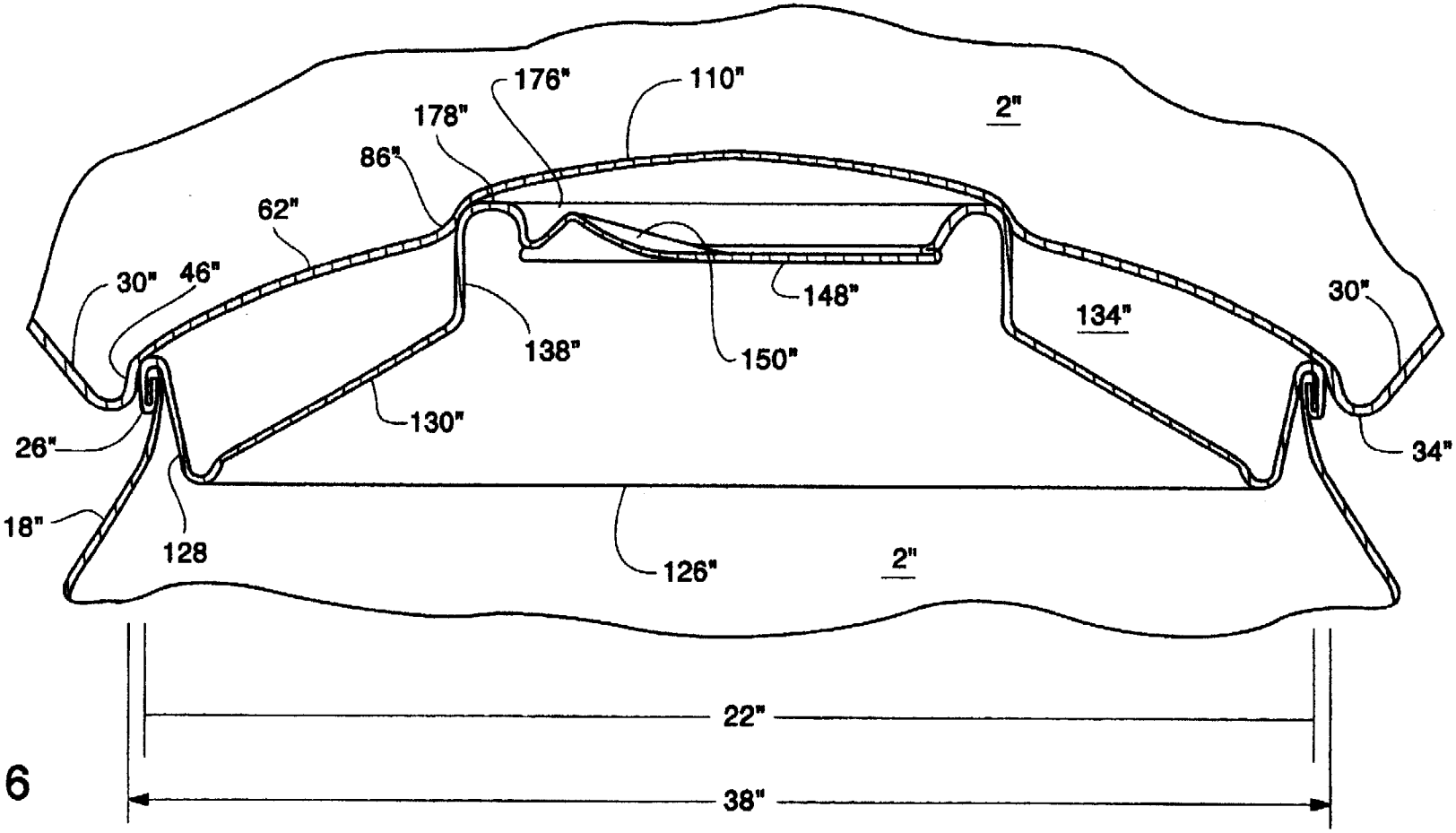
FIG. 6 is a cross-sectional view of adjacent portions of two stacked containers utilizing another type of stacking configuration.
Figure 7:
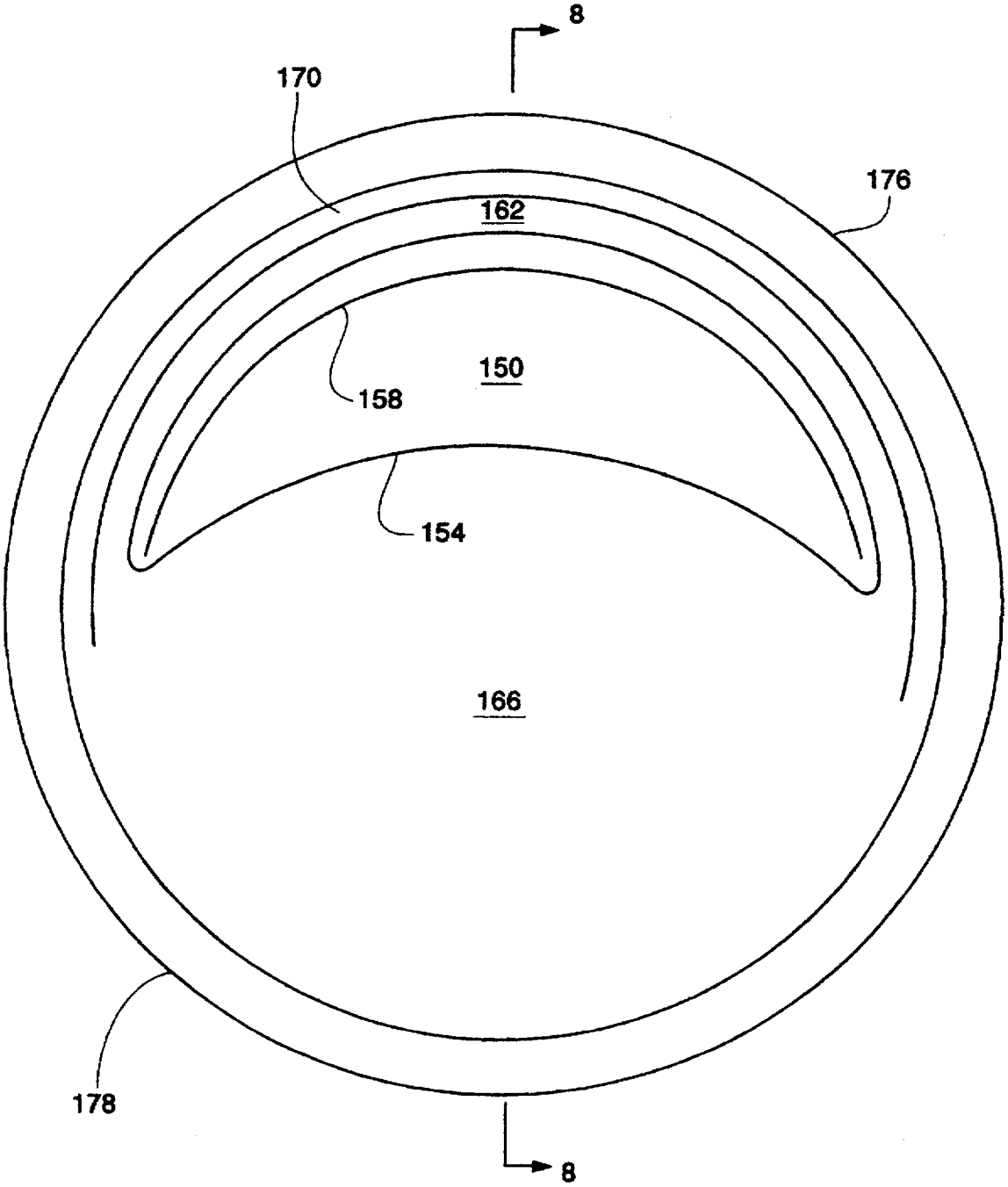
FIG. 7 is a top view of one embodiment of a tab for a container end piece.
Figure 8:
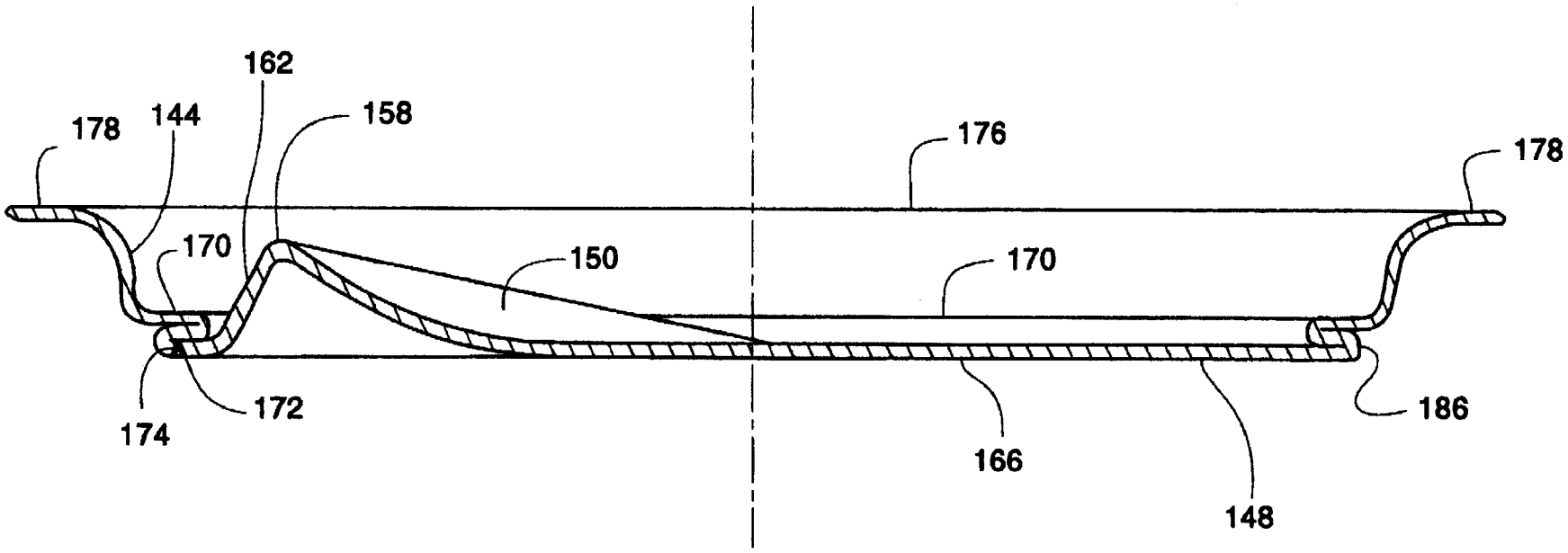
FIG. 8 is a cross-sectional view of the tab of FIG. 7 taken along line 8—8.

A further stacking configuration is illustrated in FIG. 6. The dimensions of the container 2" illustrated in FIG. 6 have also been modified to annularly support the upper container 2" at two discrete locations as in the case of the containers 2' of FIG. 5. However, in this case the inner annular support diameter 38" has been selected to be greater than the seam diameter 22" such that the annular support 34" of the upper container 2" is disposed outwardly of the seam 26" of the lower container 2". The seam 26" of the lower container 2" may contact either the inner wall 46" of the lower container 2", the first stage dome 62", and/or the arcuate interconnection therebetween. For increased interlocking, preferably the seam 26" of the lower container 2" is snugly received at the interconnection between the inner wall 46" and the first stage dome 62" of the upper container 2". Since stacking occurs on the inside of the annular support 34", this allows the configuration of the transition wall 30" to not be dictated by stacking requirements.

The crown 134" illustrated in FIG. 6 is also modified from the crown 134 illustrated in FIGS. 1 and 4. Generally, the crown 134" includes a substantially vertically extending, cylindrical sidewall 138", and the top 176", more specifically the perimeter section 178" thereof, is generally semi-circular and generally vertically oriented. Notwithstanding the noted differences between the end piece 126" and the end piece 126, the tab 148" utilized by the end piece 126" is generally structurally similar to the push-down tab 148 utilized by the end piece 126.

As noted above, the crown 134 functions to provide for effective dispensing of the contents of the container 2. Referring to FIGS. 7–11, the top 176 of the crown 134 again includes the perimeter section 178 and this section 178 defines a recess 144. An annular double seam 170 extends about the perimeter of the recess 144 in a lower portion thereof (i.e., the double seam 170 is disposed below the uppermost surface of the top 176 of the crown 134). Generally, the double seam 170 is formed by folding portions of the top 176 over onto itself in the illustrated configuration.

The top 176 also includes an openable structure, namely a push-down gate, flap or tab 148, which includes a substantially planar base panel 166 and an engagement section 150 which is offset relative to the center of the push-down tab 148 which in the illustrated embodiment coincides with the central axis 10, although the crown 134 and thus the push-down tab 148 could be offset relative to the central axis 10 of the container 2 (not shown). A transition section 162 extends between the engagement section 150 and the double seam 170. An annular perimeter of the push-down tab 148 is positioned under the upper part of the double seam 170 and thus is part of the double seam 170. Consequently, when the push-down tab 148 is opened in the manner discussed below, the remaining upper orifice does not include any sharp edges (e.g., the doubling over of the sheet metal to define the double seam 170 provides a rounded surface for engagement by the lips of the beverage consumer even after the container 2 is opened). Although different segments are referred to with regard to the end piece 126, it will be appreciated that in the illustrated embodiment it is integrally formed (i.e., of continuous construction and made from a single piece of sheet metal).

Figure 9:
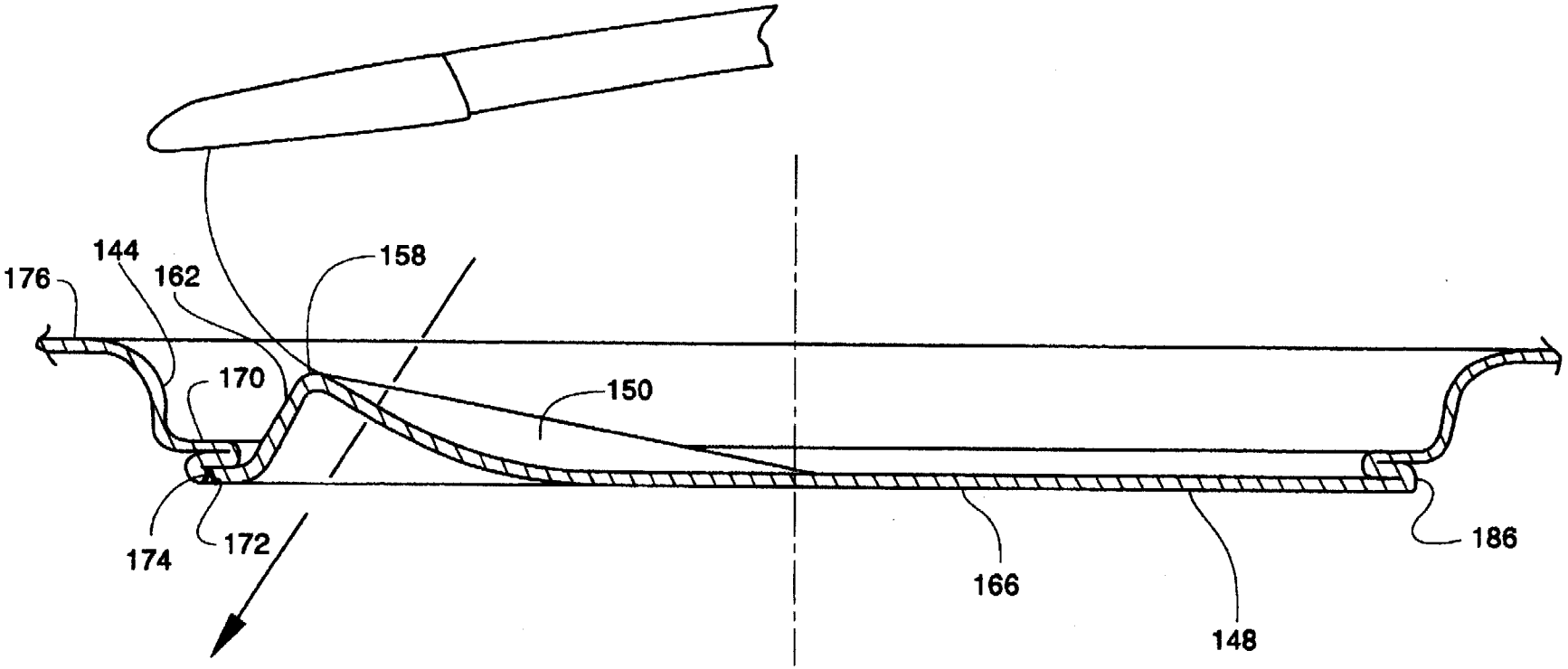
FIG. 9 is the tab of FIG. 8 with a beverage consumer's thumb in position to open the container.

The engagement section 150 is configured to allow for effective opening of the push-down tab 148 and as noted above provides advantages for the illustrated end piece 126 as well as potentially other configurations. Initially, the engagement section 150 has its perimeter defined by a first arc 154 and a second arc 158. Moreover, the engagement section 150 curves upwardly from the first arc 154, which is positioned closer to the center of the push-down tab 148, toward the second arc 158. The second arc 158 thereby defines a ridge which is arcuately disposed about the push-down tab's 148 central axis (although not necessarily at a continuous radius). Consequently, the engagement section 150 may be characterized as a substantially concave, arcuate surface. Moreover, the engagement section 150 may be further characterized as being an upwardly ramped surface from an interior portion of the push-down tab 148 to a more perimeter portion thereof. Furthermore, the engagement section 150 may be further characterized as generally approximating the contour of a human beverage consumer's thumb as illustrated in FIG. 9 and thus providing a comfortable surface for interacting with the beverage consumer.

Although the engagement section 150 may be of varying dimensions, in one embodiment, the first arc 154 and the second arc 158 each are a radius of 0.340". Moreover, the curvature between the first arc 154 and the second arc 158 (i.e., the degree of concavity) is a radius of about 0.750". Furthermore, the engagement section 150 extends a vertical distance of about 0.050" above the base panel 166, in comparison to the uppermost surface of the top 176 which extends a vertical distance of about 0.100" above the base panel 166.

Figure 10:
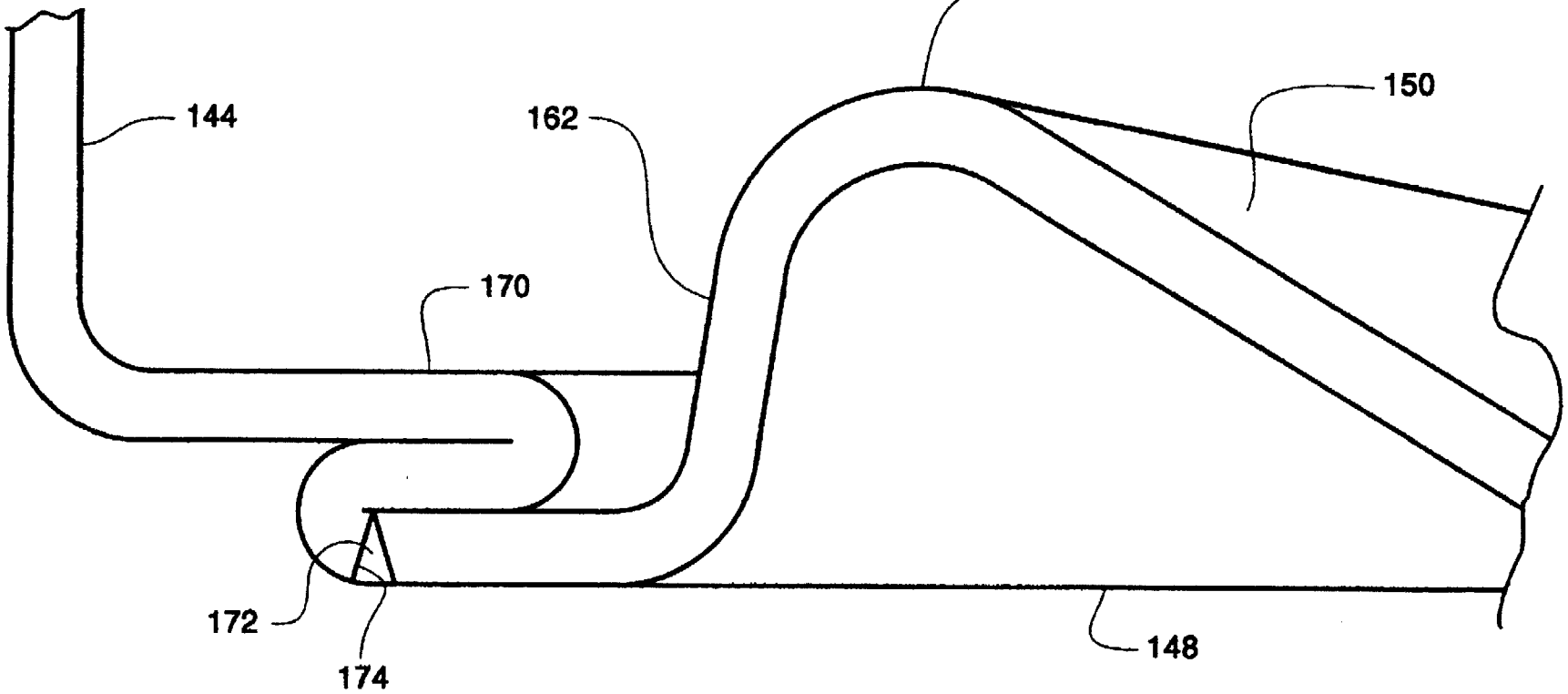
FIG. 10 is an enlarged cutaway view of the fracturable web of the tab of FIG. 7.
Figure 11:
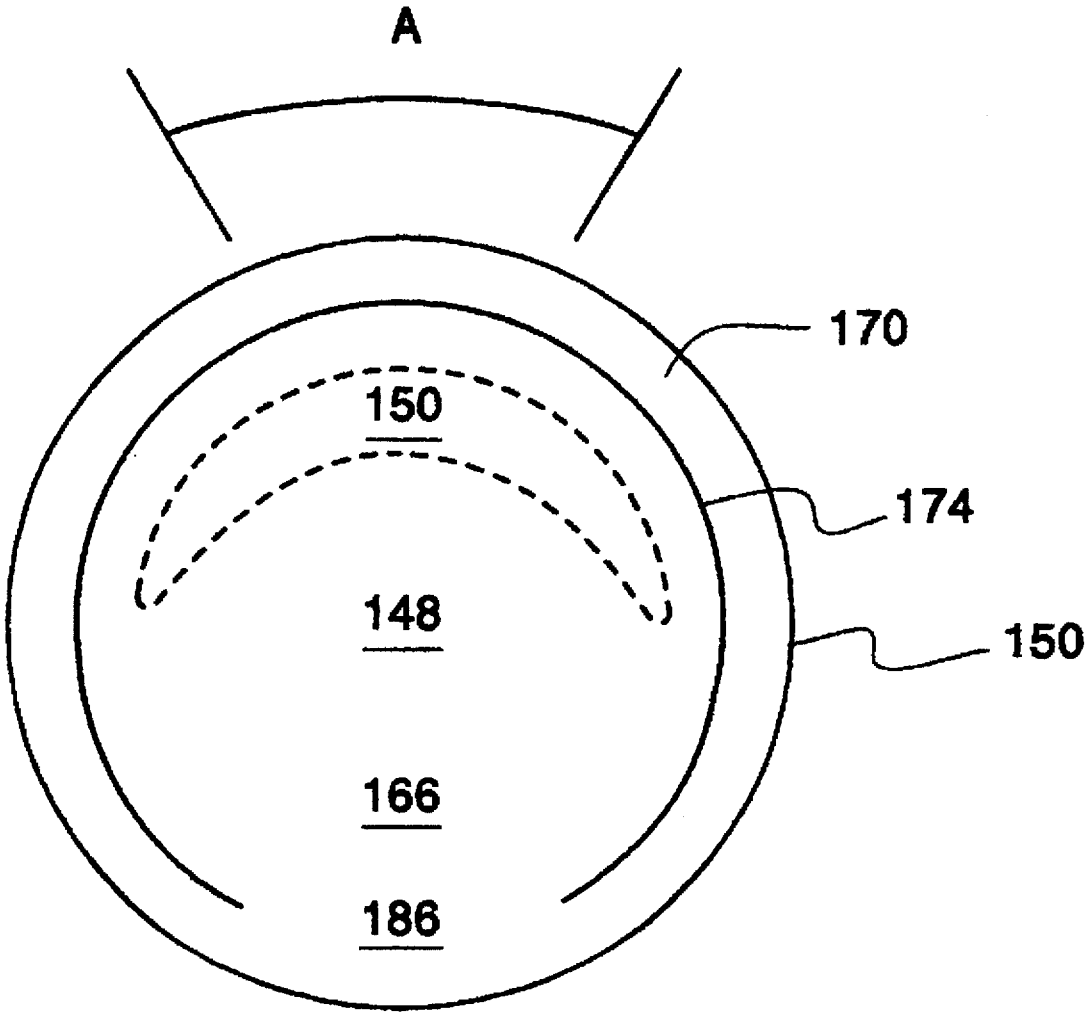
FIG. 11 is a bottom view of the tab of FIG. 7.

In addition to providing a comfortable surface for engagement by a beverage consumer, the engagement section 150 and further characteristics of the push-down tab 148 interact to provide an easy-to-open push-down tab 148 as illustrated in FIGS. 10–11. Initially, a portion of the perimeter of the push-down tab 148 includes a fracturable web 174 defined by a score, while a remaining portion of the perimeter defines a hinged connection 186 (e.g., having an arc length of about 0.187") defined by perimeter of the base panel 166. As such, the push-down tab 148 may be depressed within the interior of the container 2 to affect an opening thereof (shown in FIG. 13 in a similar embodiment). The "resistance" of the fracturable web 174 to fracture decreases along the perimeter as the distance from the hinged connection 186 increases. For instance, the thickness of the fracturable web 174 may decrease as the distance from the hinged connection 186 increases along the perimeter of the tab 148. Consequently, the structurally weakest part of the fracturable web 174 is substantially adjacent the second arc 158 of the engagement section 150 which reduces the forces required to open the tab 150.

Although the fracturable web 174 may be formed in a variety of manners, in one embodiment a substantially V-shaped groove is scored, stamped or cut into the lower surface of the tab 148. In order to further reduce the forces required to open the push-down tab 148, over the arc length A illustrated in FIG. 11 (e.g., about 0.250"), the V-shaped score extends virtually entirely through the push-down tab 148 as illustrated in FIG. 10. An appropriate filler material 172 (e.g., "Hot Melt" available from National Starch & Chemical Company or another suitable sealant) is then used to fill in the score and define an easy-to-open fracturable web 174. Consequently, this further reduces the forces required for fracture where the primary fracturing forces will be directed (at the engagement section 150). Moreover, due to the orientation of the engagement surface 150 in that it causes the opening forces to not only be exerted in a downward direction as illustrated in FIG. 9, but toward this weakest part of the fracturable web 174 as well (at the arc A per FIG. 11), further reduction in the forces required to open the push-down tab 148 are realized.

Another feature relating to the fracturable web 174 and the remaining portion of the perimeter of the push-down tab 148 is that it is positioned under the upper part of the double seam 170 and has a larger effective diameter. Therefore, in the event that the push-down tab 148 breaks off at the hinged connection 186 in addition to the fracturable web 174, the potential for the push-down tab 148 passing out of the container 2 is desirably reduced. Moreover and as noted above, upon opening of the push-down tab 148 the upper surface of the remaining orifice is formed by a rounded edge of the remainder of the double seam 170.

Figure 12:
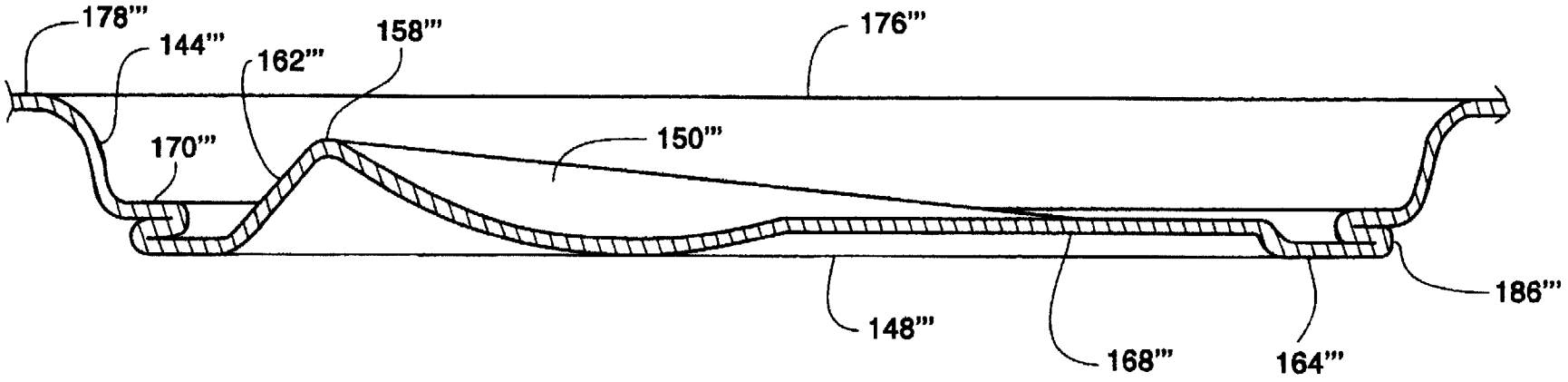
FIG. 12 is a cross-sectional view of another embodiment of a tab.
Figure 13:
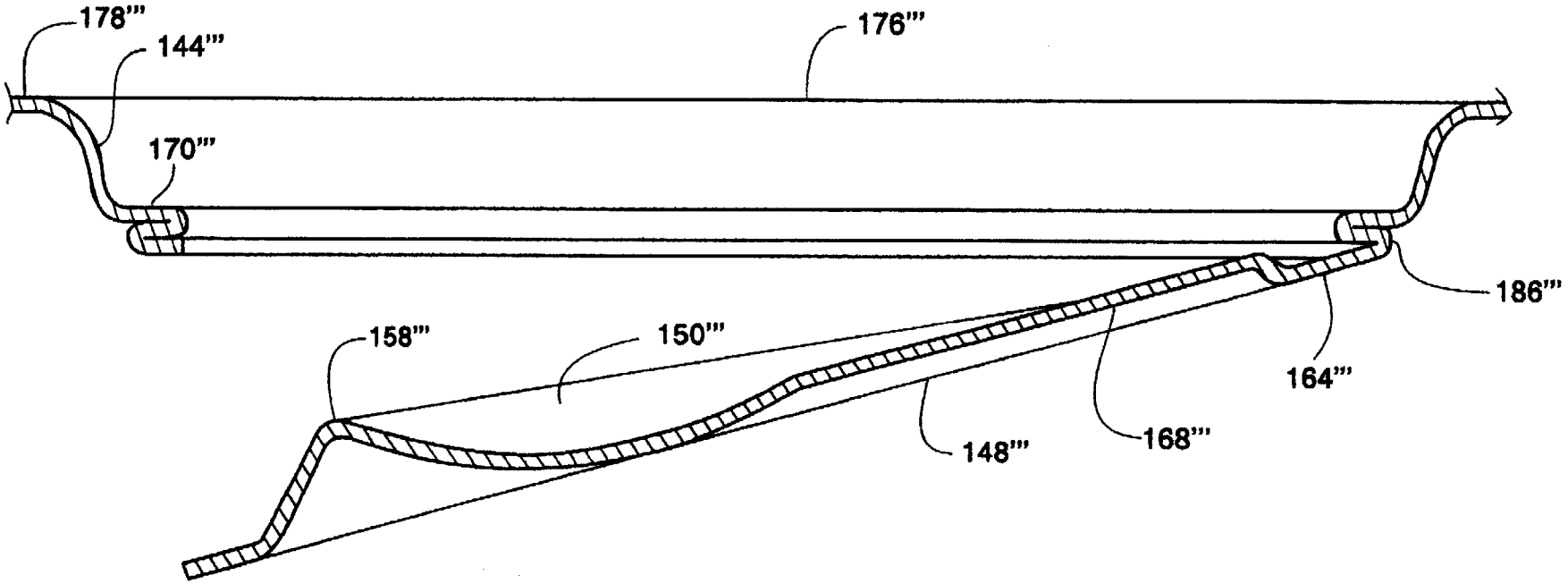
FIG. 13 is a cross-sectional view of the tab of FIG. 12 in the opened position.

A construction similar to the tab 148 of FIGS. 7–12 is illustrated in FIGS. 12–13. Generally, the push-down tab 148''' includes an engagement section 150''' which initially dips down below a plane containing the second base panel 168''' before curving upwardly. Otherwise, the engagement section 150''' may be substantially similar to the engagement section 150 discussed above. The push-down tab 148''', however, further includes a first base panel section 164''' adjacent the double seam 170''' which is substantially within the same reference plane as the "lowest" part of the engagement section 150'''. Consequently, the first base panel section 164''' is offset from the second base panel section 168'''. FIG. 13 illustrates the push-down tab 148''' in the normal opened position.

As in the case of the push-down tab 148 discussed above, the structure of the push-down tab 148''' provides benefits in and of itself such that it may be desirable to utilize the push-down tab 148''' with other end piece configurations, including those described herein, as well as "conventional" soft drink/beer container end pieces as noted above.

Figure 14:
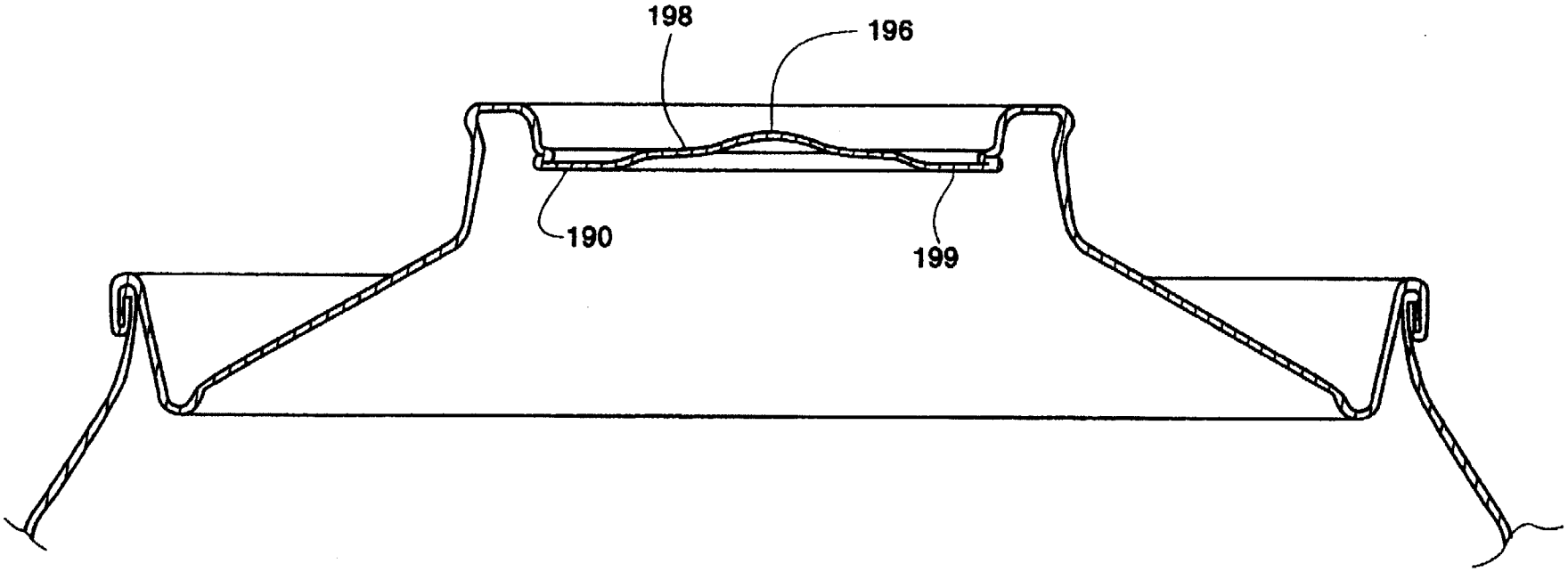
FIG. 14 is a cross-sectional view of another embodiment of an end piece.
Figure 15:
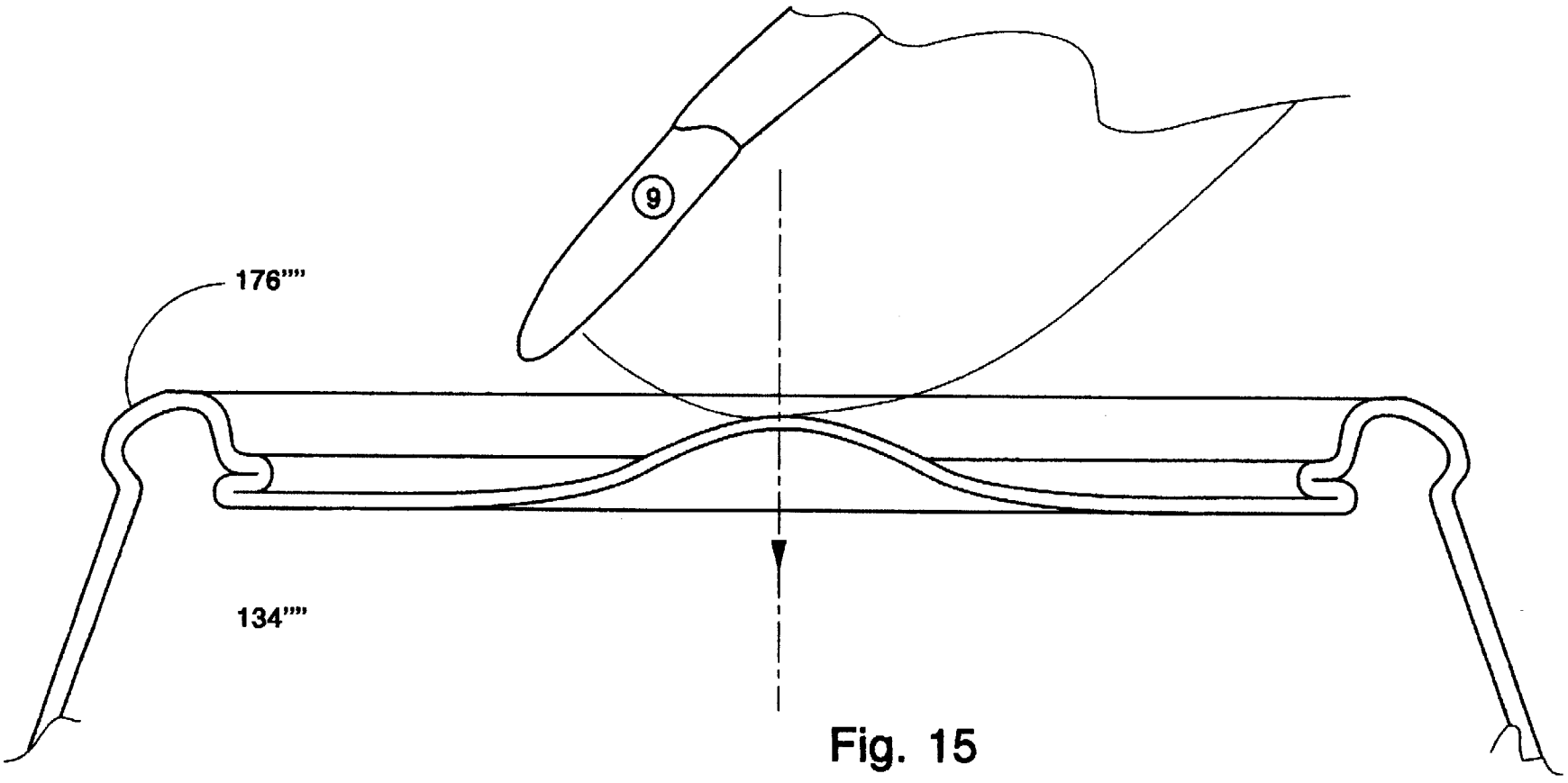
FIG. 15 is a view of another embodiment of an end piece with a beverage consumer's thumb in position to open the container.

Referring to FIGS. 14–15, other structures of the crown and/or tab are illustrated therein and which may be used in at least one aspect of the present invention. Referring to FIG. 14, the push-down tab 190 includes a centered first stage engagement section 196, an offset second stage 198, and a third stage 199 versus the above-described concave engagement section 150 and base panel 166. Moreover, the crown 134'''' of FIG. 15 differs from the crowns discussed above, utilizing more of a box-shaped or rectangular-shaped cross section for the top 176'''', and includes a single centered button for an engagement section.

Another embodiment of a push-down tab which may be used for opening a container is illustrated in FIGS. 16–19. Initially, the push-down tab 202 is illustrated in combination with a crown-top end piece as in the case of the previously addressed embodiments. As such, the end piece 126$^{v}$ includes a crown 134$^{v}$ having a crown top 176$^{v}$ and a crown sidewall (not shown). The top 176$^{v}$ of the crown 134$^{v}$ again includes the perimeter section 178$^{v}$ and this section 178$^{v}$ defines the recess 144$^{v}$. The annular double seam 170$^{v}$ extends about the perimeter of the recess 144$^{v}$ in a lower portion thereof (i.e., the double seam 170$^{v}$ is disposed below the uppermost surface of the top 176$^{v}$ of the crown 134$^{v}$).

The end piece 126$^{v}$ also includes the push-down tab 202 for opening the container via the hinged connection 186$^{v}$ and the fractuable web 174$^{v}$ defined by a score which may contain a filler 172$^{v}$. The hinged connection 186$^{v}$ in one embodiment has a length of about 3/16". Instead of providing a single engagement section for a user's finger (e.g., thumb) as in the case of the above-described embodiments, the push-down tab 202 includes a first engagement section 204 and a second engagement section 216 which are simultaneously engaged by the user's finger when opening the push-down tab 202. Generally, a forward portion of the user's finger rests against the first engagement section 204 while a more rearwardly disposed portion of the consumer's finger rests against the second engagement section 216. As such, the consumer's finger generally "points" in the direction of the hinged connection 186$^{v}$ about which the push-down tab 202 effectively pivots when opened. This "reversal" of finger positioning in relation to conventional opening techniques (where the consumer's finger generally "points" in the direction of the score) and including those discussed in relation to the above-described embodiments provides a number of advantages.

In the case of the push-down tab 202, the consumer's finger is in effect disposed directly above the area which the opened container "vents." That is, in the case of pressurized beverages, the user's finger and/or remaining portions of the user's hand shields any venting of fluid from the opened container which commonly occurs upon opening. Moreover, it is believed that less force is required to open the push-down tab 202 in comparison to other push-down tabs, including those described herein. Furthermore, the advancement of the consumer's finger into the beverage container upon the opening of the same is controlled in that the tip of the consumer's finger maintains engagement with at least part of the first engagement section 204. In fact, the first engagement section 204 actually provides resistance to the downward advancement of the consumer's finger into the container (i.e., no "slap open" effect). This feature is believed to increase the confidence of the user in that the user perceives that the risk of injury is greatly reduced utilizing the push-down tab 202.

The first engagement section 204 orients the user's finger in the correct position on the push-down tab 202 and also facilitates in the opening of the push-down tab 202. Generally, the first engagement section 204 is offset in relation to a central vertical axis extending through the push-down tab 202. Moreover, the profile of the first engagement section 204 is generally crescent-like. The first engagement section 204 has its perimeter defined by a first arc 208 and a second arc 212 and the first engagement section 204 curves upwardly from the first arc 208, which is positioned closer to the center of the push-down tab 202, toward the second arc 212. The second arc 212 thereby defines a ridge which is arcuately disposed about the push-down tab's 202 central axis (although not necessarily at a continuous radius).

Based upon the foregoing and further upon a review of FIGS. 16–19, the first engagement section 204 is subject to a number of characterizations. Initially, the first engagement section 204 may be properly characterized as a generally concave, arcuate surface. Moreover, the first engagement section 204 may be characterized as being an upwardly ramped surface, and more specifically a surface which extends generally upwardly progressing toward a perimeter of the push-down tab 202. Furthermore, the first engagement section 204 may be further characterized as generally approximating the contour of that portion of the user's finger which is engaged therewith (e.g., anatomically contoured).

Although the first engagement section 204 may be of varying dimensions, in one embodiment, the first arc 208 has a radius of about 0.360 and the second arc 212 has a radius of about 0.540. Moreover, the curvature between the first arc 208 and the second arc 212 (i.e., the degree of concavity) is defined by a radius of about 0.750. Furthermore, the first engagement section 204 extends a vertical distance of about 0.035 above the tab base 228 of the push-down tab 202, in comparison to the uppermost surface of the top 176$^{v}$ which extends a vertical distance of about 0.085 above the tab base 228. Moreover, the first engagement section 204 extends upwardly in the noted manner at an angle of about 12° off of horizontal.

The second engagement section 216 is primarily for applying the forces which are used to open the push-down tab 202 by separating it along the fracturable web 174$^{v}$. Generally, the second engagement section 216 is offset in relation to a central vertical axis extending through the push-down tab 202. Moreover, the profile of the second engagement section 216 is generally football-shaped. The second engagement section 216 has its perimeter defined by a first arc 220 and a second arc 224 and the second engagement section 216 curves upwardly from the first arc 220, which is positioned closer to the center of the push-down tab 202, toward the second arc 224. The second arc 224 thereby defines a ridge which is arcuately disposed about the push-down tab's 202 central axis (although not necessarily at a continuous radius).

Based upon the foregoing and further upon a review of FIGS. 16–19, the second engagement section 216 is subject to a number of characterizations. Initially, the second engagement section 216 may be properly characterized as a generally concave, arcuate surface. Moreover, the second engagement section 216 may also be characterized as being an upwardly ramped surface, and even more specifically a surface which extends generally upwardly progressing toward a perimeter of the push-down tab 202. Furthermore, the second engagement section 216 may be further characterized as generally approximating the contour of a portion of the user's finger engaged therewith (e.g., anatomically contoured).

Although the second engagement section 216 may be of varying dimensions, in one embodiment, the first arc 220 has a radius of about 0.425 and the second arc 224 has a radius of about 0.312. Moreover, the curvature between the first arc 220 and the second arc 224 (i.e., the degree of concavity) is defined by a radius of about 0.750. The second engagement section 216 also extends upwardly in the noted manner at an angle of about 8° off of horizontal. Furthermore, the second engagement section 216 extends a vertical distance of about 0.025 above the tab base 228, in comparison to the uppermost surface of the top 176$^{v}$ which extends a vertical distance of about 0.085 above the tab base 228. As such, the uppermost portion of the second engagement section 216 is at a lower elevation than the uppermost portion of the first engagement section 204. Since it is believed that the majority of forces used to open the push-down tab 202 are directed via the second engagement section 216, this reduces the potential for inadvertent opening of the push-down tab 202 (e.g., when dropped).

The first and second engagement sections 204, 216 are believed to facilitate an effective opening of the push-down tab 202. Initially, the second engagement section 216 assumes a generally opposing position relative to the first engagement section 204. Specifically, the second engagement section 216 and the first engagement section 204 extend away from a common point in generally opposite directions (e.g., they extend upwardly away from a common point in generally opposite directions). As such, the first and second engagement sections 202, 216 collectively define a generally concave surface for receiving a beverage consumer's finger and positioning the finger to effectively open the push-down tab 202. Moreover, the first and second engagement sections 204, 216 provide guidance as to the positioning of the user's finger which should be utilized to open the push-down tab 202.

Figure 16:
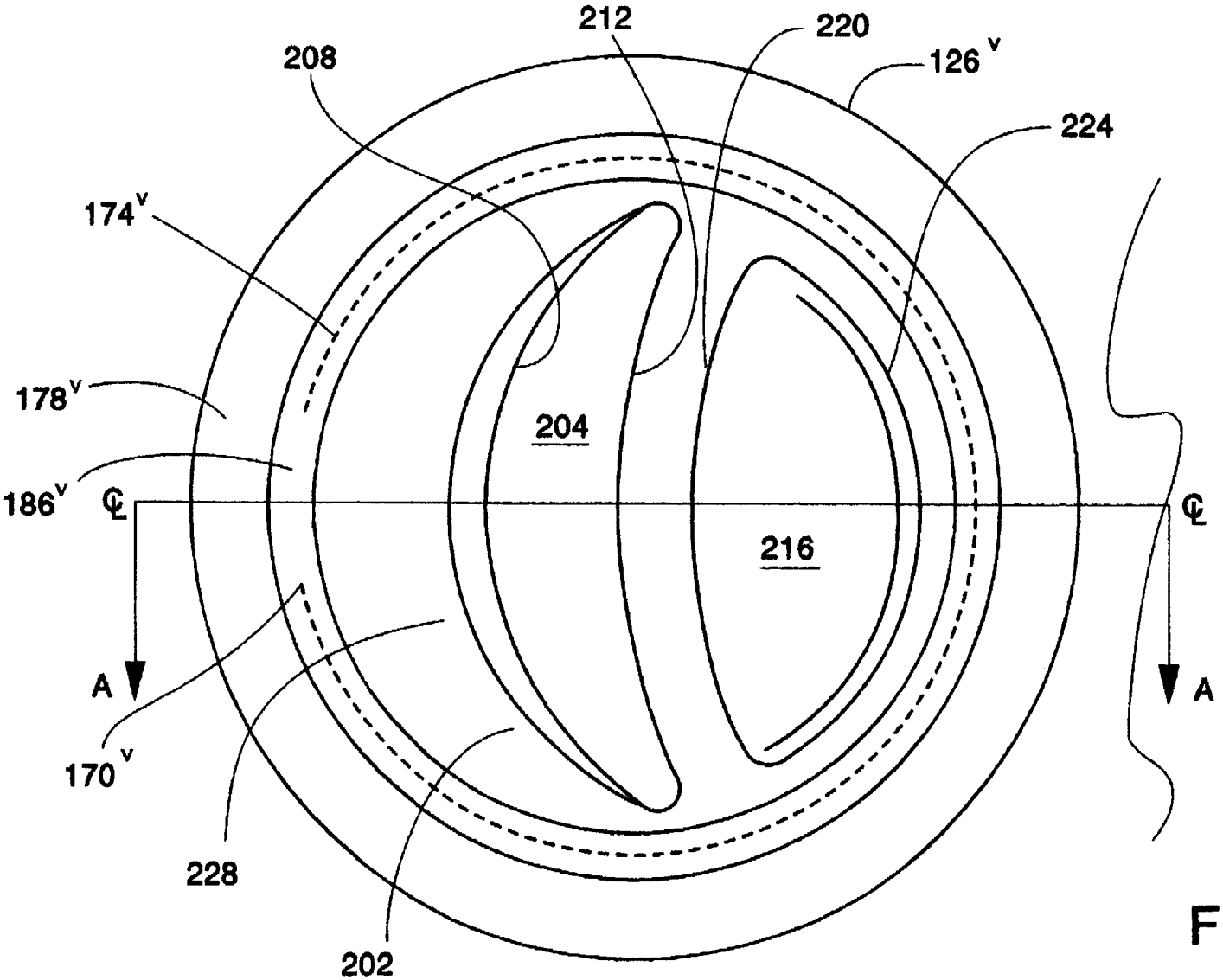
FIG. 16 is a top view of another embodiment of a push-down tab for a container end piece.
Figure 17:
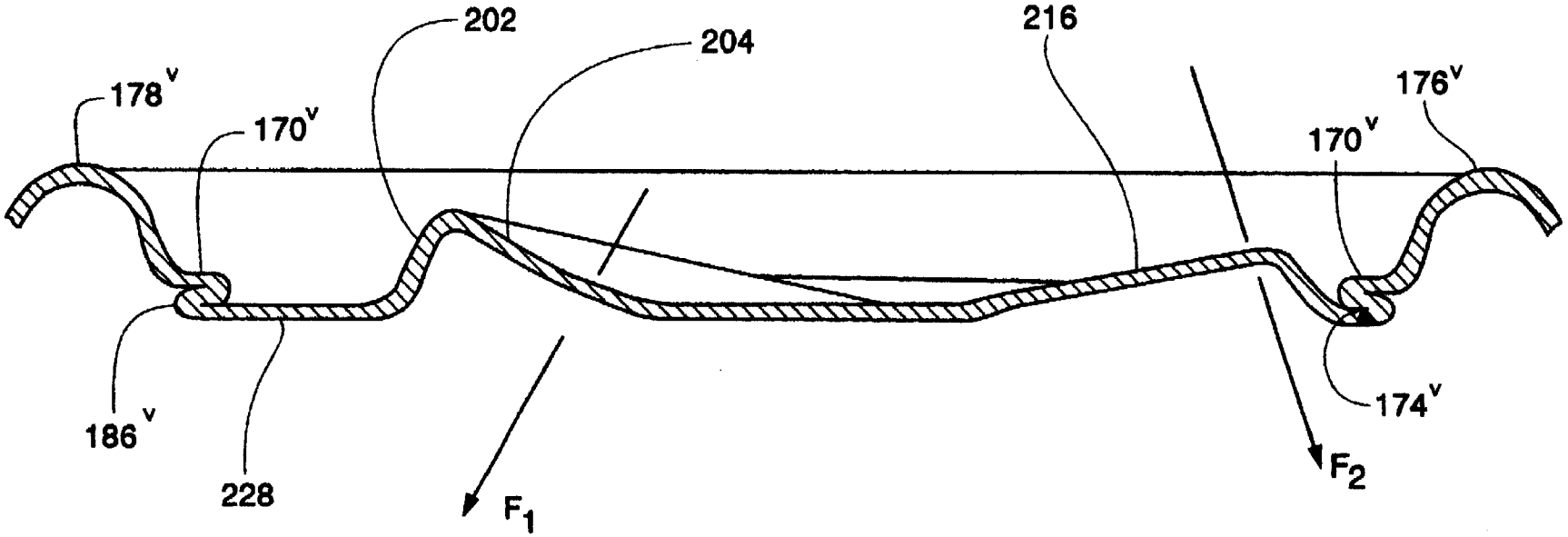
FIG. 17 is a cross-sectional view of the push-down tab of FIG. 16 taken along line 17—17 with a user's finger in position to open the container.
Figure 18:
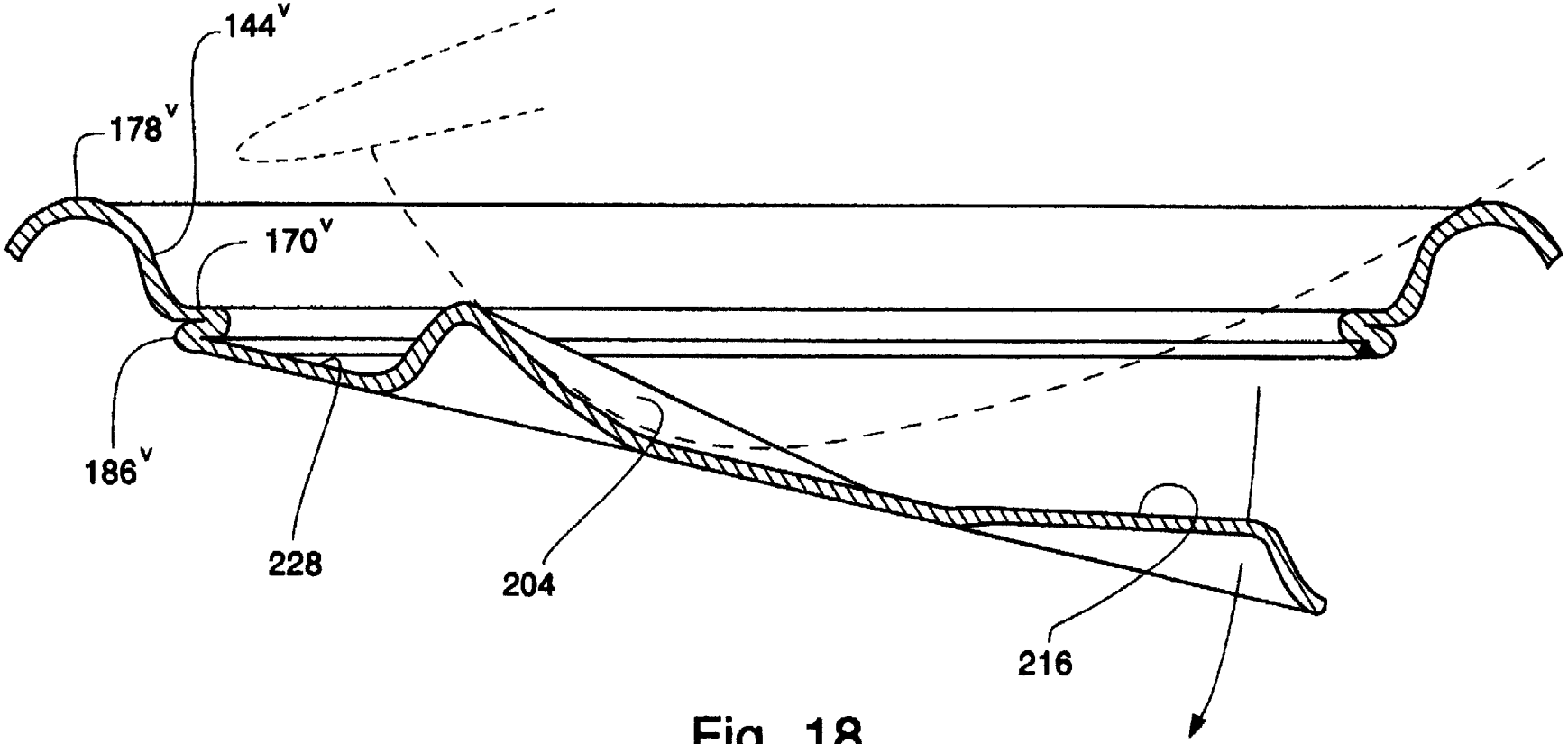
FIG. 18 is the push-down tab of FIG. 17 when partially opened and illustrating the positioning of the user's finger.
Figure 19:
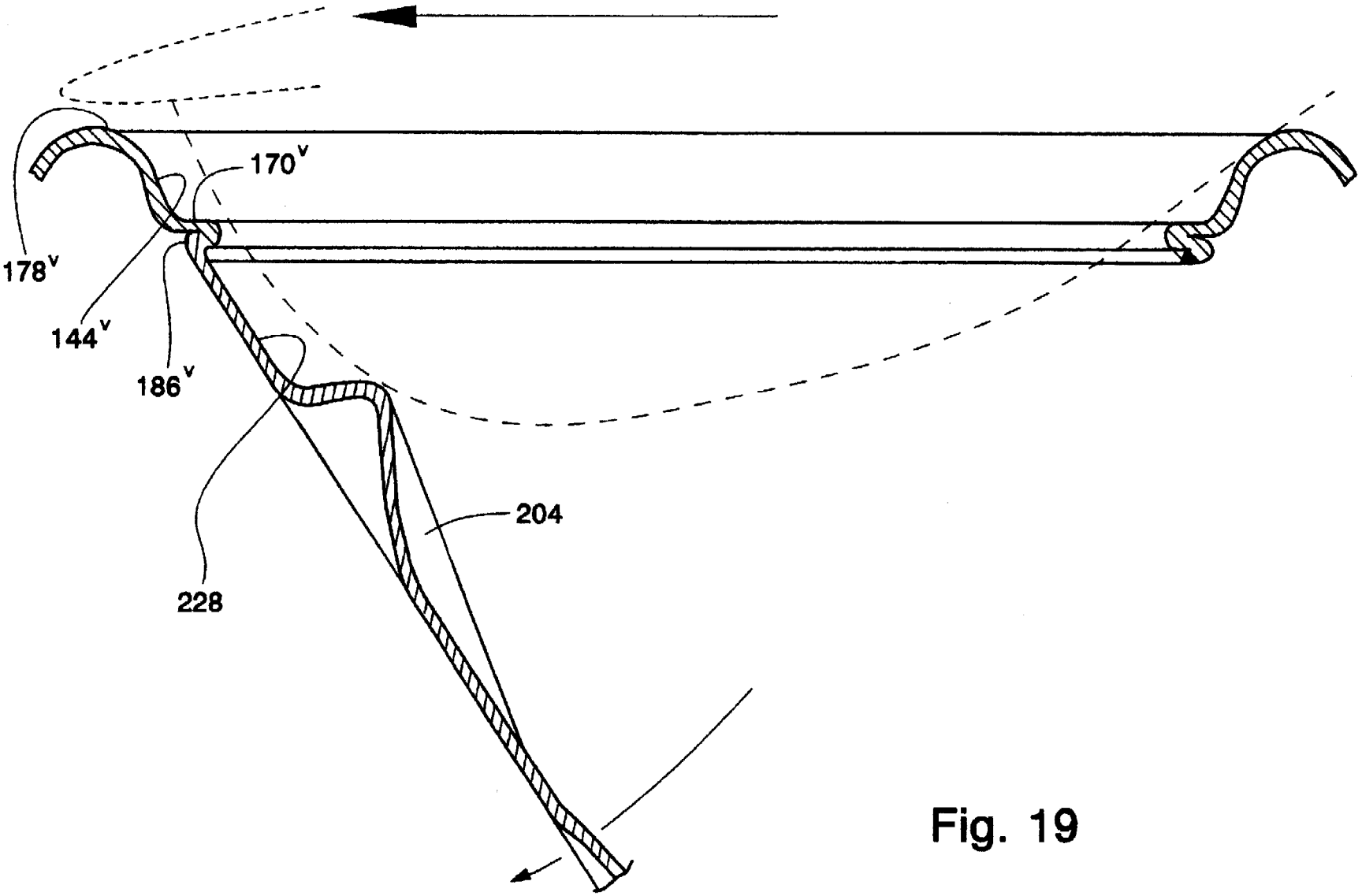
FIG. 19 is the push-down tab of FIG. 17 when the fully opened position and illustrating the positioning of the user's finger.

When the consumer exerts a generally downward force on the push-down tab 202, the direction of the forces exerted on the first and second engagement sections 204, 216 are illustrated by the arrows $F_1$ and $F_2$ in FIG. 16. Again, it is believed that reduced forces are required to open the push-down tab 202 in relation to other embodiments described herein and that such is attributed to the positioning of the user's finger in relation to the second engagement section 216. Once the push-down tab 202 begins to separate along the web 174$^{v}$, the user's finger begins to effectively "cam" up the first engagement section 204. This not only facilitates further opening of the push-down tab 202 (e.g, a further downward pivoting of the push-down tab 202 about the hinged connection 186$^{v}$), but again provides support or resistance to movement of the user's finger down into the container. That is, the continued contact between the user's finger and the first engagement section 204 reduces what has been characterized as a "slap open" effect in comparison with other types of push-down tabs. It is believed that users will be less apprehensive using the push-down tab 202 since there is no slap open effect, since the push-down tab 202 provides a better "feel", and since it is believed that less forces are required to open the push-down tab 202.

The foregoing description of the present invention has been presented for purposes of illustration and description. Furthermore, the description is not intended to limit the present invention to the form disclosed herein. Consequently, variations and modifications of the present invention which are commensurate with the above teachings to those having skill or knowledge of the relevant art, are also within the scope of the present invention. For instance, various of the tab constructions may be used with one or more of the crown/end piece configurations for at least one aspect of the present invention. The embodiments described hereinabove are further intended to explain best modes known of practicing the invention to enable others skilled in the art to utilize the invention in such or other embodiments and with the various modifications required by their particular applications or uses of the present invention. It is intended that the appended claims be construed to include alternative embodiments to the extent permitted by the prior art.

What is claimed is:

1. An endpiece separately attachable to a container body, said endpiece comprising a first surface which interfaces with an interior of said container body when said endpiece is attached to said container body and a second surface opposite said first surface and thereby defining an exterior surface of said endpiece, said second surface of said endpiece comprising:

an openable push-down tab interconnected with at least a portion of a remainder of said endpiece at a first hinged connection and comprising first and second raised engagement sections which are each separate structures from said first hinged connection and which each, prior to an opening of said push-down tab, generally extend upwardly progressing toward a perimeter of said tab relative to an interior reference point associated with said tab, said first and second engagement sections being disposed on said tab to be simultaneously engaged by a user to assist in an opening of said push-down tab by the user, said push-down tab further comprising a first section disposed between and separating said first and second engagement sections, wherein prior to an opening of said push-down tab and any separation of said push-down tab from said remainder of said endpiece; i) said first and second engagement sections extend upwardly and away relative to said interior reference point in generally opposite directions; ii) an uppermost portion of said second engagement section is disposed at a lower elevation than an uppermost portion of said first engagement section in that it is disposed more in a direction of said first surface than said uppermost portion of said first engagement section; and iii) said uppermost portion of said first engagement section is disposed closer to said first hinged connection than said uppermost portion of said second engagement section.

2. An endpiece, as claimed in claim 1, wherein:

said first engagement section is disposed to be engaged by a forward portion of the user's thumb and said second engagement section is disposed to be engaged by a more rearwardly disposed portion of the user's thumb.

3. An endpiece, as claimed in claim 2, wherein:

said perimeter of said tab is defined by said first hinged connection and a score along which said tab separates from an adjacent portion of said endpiece when said push-down tab is opened, wherein said second engagement section is disposed on said push-down tab generally opposite said first hinged connection whereby said first engagement section is disposed between said first hinged connection and said second engagement section.

4. An endpiece, as claimed in claim 1, wherein:

said first and second engagement sections are each defined by a generally concave, arcuate surface prior to any application of an external force to said second surface of said endpiece to open said push-down tab.

5. An endpiece, as claimed in claim 4, wherein:

said generally concave, arcuate surfaces of said first and second engagement sections each substantially approximate a curvature of a corresponding portion of the user's finger when simultaneously disposed on said first and second engagement sections.

6. An endpiece, as claimed in claim 1, wherein:

prior to an opening of said push-down tab said first and second engagement sections are each generally an upwardly ramped surface progressing toward said perimeter of said tab.

7. An endpiece, as claimed in claim 6, wherein:

a slope of said first engagement section is greater than a slope of said second engagement section.

8. An endpiece, as claimed in claim 6, wherein:

said perimeter of said tab is defined by said first hinged connection and a score along which said tab separates from an adjacent portion of said endpiece when said push-down tab is opened.

9. An endpiece, as claimed in claim 1, wherein:

said perimeter of said tab is defined by said first hinged connection and a score along which said tab separates from an adjacent portion of said endpiece when said tab is opened, wherein when a user's thumb simultaneously engages said first and second engagement sections and exerts a generally downwardly directed force on said tab, a first force vector is perpendicular to said first engagement section and a second force vector is perpendicular to said second engagement section, wherein one of said first and second force vectors is directed generally toward said portion of said score positioned opposite said first hinged connection and the other of said first and second force vectors is directed generally away from said portion of said score and thereby generally toward said first hinged connection.

10. An endpiece, as claimed in claim 1, wherein:

said push-down tab further comprises a substantially planar, horizontally disposed second section prior to an opening of said push-down tab, said second section being disposed outwardly from said first engagement section relative to said interior reference point, wherein said first panel section is substantially planar and horizontally disposed prior to an opening of said push-down tab.

* * * * *